US008806782B2

(12) United States Patent
Sun

(10) Patent No.: US 8,806,782 B2
(45) Date of Patent: Aug. 19, 2014

(54) RESILIENT SOLE

(76) Inventor: Zhifei Sun, Guangzhou (CN)

( * ) Notice: Subject to any disclaimer, the term of this patent is extended or adjusted under 35 U.S.C. 154(b) by 715 days.

(21) Appl. No.: 12/227,424

(22) PCT Filed: May 17, 2007

(86) PCT No.: PCT/CN2007/001618

§ 371 (c)(1),
(2), (4) Date: Feb. 25, 2009

(87) PCT Pub. No.: WO2007/134530

PCT Pub. Date: Nov. 29, 2007

(65) Prior Publication Data

US 2009/0293311 A1 Dec. 3, 2009

(30) Foreign Application Priority Data

May 18, 2006 (CN) ..... 2006 2 0059084 U

(51) Int. Cl.

| | |
|---|---|
| ***A43B 7/22*** | (2006.01) |
| ***A43B 1/00*** | (2006.01) |
| ***A43B 13/18*** | (2006.01) |
| ***A43B 13/12*** | (2006.01) |
| ***A43B 7/14*** | (2006.01) |
| ***A43B 13/14*** | (2006.01) |
| *A43B 13/20* | (2006.01) |

(52) U.S. Cl.

CPC ..... *A43B 7/146* (2013.01); *A43B 13/146* (2013.01); *A43B 13/181* (2013.01); *A43B 13/20* (2013.01)

USPC ..... 36/102; 36/88; 36/28; 36/30 R; 36/3 B

(58) Field of Classification Search

CPC ..... A43B 7/08; A43B 7/146; A43B 7/14; A43B 13/20; A43B 13/18; A43B 13/146; A43B 13/14; A43B 13/181; A43B 13/145; A43B 13/206

USPC ..... 36/43, 44, 71, 141, 102, 88, 28, 30 R, 36/3 A, 3 B, 3 R

See application file for complete search history.

(56) References Cited

U.S. PATENT DOCUMENTS

| | | | | | |
|---|---|---|---|---|---|
| 2,090,881 | A | * | 8/1937 | Wilson | 36/29 |
| 4,071,963 | A | * | 2/1978 | Fukuoka | 36/3 B |
| 4,223,456 | A | * | 9/1980 | Cohen | 36/29 |
| 4,547,978 | A | * | 10/1985 | Radford | 36/3 B |
| 5,035,068 | A | * | 7/1991 | Biasi | 36/3 R |
| 5,619,809 | A | * | 4/1997 | Sessa | 36/3 R |
| 5,853,844 | A | * | 12/1998 | Wen | 428/119 |
| 6,076,282 | A | * | 6/2000 | Brue' | 36/3 B |
| 6,209,226 | B1 | * | 4/2001 | Squadroni | 36/3 B |

(Continued)

FOREIGN PATENT DOCUMENTS

| | | |
|---|---|---|
| CN | 2109103 | 7/1992 |
| CN | 2169999 | 6/1998 |

(Continued)

*Primary Examiner* — Jila M Mohandesi

(74) *Attorney, Agent, or Firm* — Hamre, Schumann, Mueller & Larson, P.C.

(57) ABSTRACT

A resilient sole comprises a foot-shaped recess on the upper layer of the sole; a plurality of resilient hollow cylinders arranged in the recess, each of the hollow cylinders having open top that is an arched surface and capable to be closed.

4 Claims, 2 Drawing Sheets

(56) References Cited

U.S. PATENT DOCUMENTS

| | | | | |
|---|---|---|---|---|
| 6,434,859 | B1 * | 8/2002 | Kim | 36/43 |
| 6,560,900 | B2 * | 5/2003 | Bray et al. | 36/17 A |
| 6,754,982 | B2 * | 6/2004 | Reed et al. | 36/30 A |
| 7,281,286 | B2 * | 10/2007 | Ganon | 12/142 T |
| 2002/0088140 | A1 * | 7/2002 | Wang et al. | 36/3 B |
| 2004/0159013 | A1 * | 8/2004 | Ganon | 36/25 R |

FOREIGN PATENT DOCUMENTS

| | | |
|---|---|---|
| EP | 0780063 | 7/1997 |
| GB | 2303780 | 3/1997 |
| WO | 03/063630 | 8/2003 |

* cited by examiner

RESILIENT SOLE

TECHNICAL FIELD

The present invention relates to a sole, in particular to a resilient sole.

BACKGROUND OF THE INVENTION

Normally, the known sole is made of resilient materials, or is provided with air cushion in the shoe heel, in order to buffer the impact of the foot on the ground during walking. As for the former, the resilient effect is not good enough to provide a favorable buffering, while for the latter one, the air cushion may be aging easily and transformed, and furthermore, an air chamber should be arranged, which complicates the manufacturing process of shoe and increases the cost. In another known sole such as Chinese patent application no. 97205638.6, a plurality of hollow cylinders which are normally made of rubber materials are densely arranged on the sole to increase the elasticity, however the elasticity is limited by the rubber itself. UK patent application publication no. GB2303780A with a title of "SPA SANDAL" discloses a sole which is provided with rounded projections, each of which has a rounded head and a hollow center; and for the top of the sole is closed, the sole should be split into a upper layer and a lower layer, or else the molding and the mold releasing can not be performed. Therefore, this kind of sole should be split into the upper and lower layers which are made in molds respectively and then stuck together to form the sole. For the reason that the flexibility and the Coefficient of Thermal expansion of the bond are different from that of the sole, which may affect the bending performance of the sole, and the upper layer and the lower layer may be separated with respect to each other during long-term walking and frequent bending. Furthermore, the bond may lose its binding force after aging. During the jumping or running, instant high pressure will be formed in the hollow cylinders, which will destroy the binding area greatly and cause the air leakage, and thus the top of the hollow cylinders will be sunk upon trample. If these hollow cylinders are made of a relative rigid material, it will be meaningless with respect to comfort and elasticity. Therefore, the sole is not durable and has quality problems as described above, and moreover, the sole should be made by binding two parts which are prepared in two sets of mould, which bring additional costs and pollution to the environment.

SUMMARY OF THE INVENTION

Having outlined the state of the prior art and its attendant shortages, it is an object of the present invention to provide a resilient sole which is of simple structure and is durable and able to regulate the contacting surface between the foot and the sole automatically to provide a resilient sole with nice performance in buffering.

The above object of the present invention is achieved by the following technical solutions:

A resilient sole, comprises a foot-shaped recess on the upper layer of the sole; a plurality of resilient hollow cylinders arranged in the recess, each of the hollow cylinders having open top that is an arched surface. The sole may be made of rubber or other suitable elastic materials. The hollow cylinders are resilient and thus able to moderate impact and further to be deformed with different extent according to the pressures at different positions so as to enable the foot to endure the minimum pressure. The open tops of the hollow cylinders that are arched surfaces are of the function of massage to the feet.

During the manufacturing of the sole, the resilient sole of the present invention, the sole can be made in only one mold by one step molding, and can be released from the mold easily. Comparing with the sole having hollow cylinders without open tops, one set of mold is saved, and thus costs in vulcanizing the mold and binding the upper layer with the lower layer of the known sole can also be saved. Furthermore, the hollow cylinder will not be split in use due to the hollow cylinders are integrated within the recess of the sole. The insole is pressed tightly on the open tops of the cylinders under the weight of human body, thus the open top is closed and the arched surface is sealed with the insole. Therefore, air chambers can be formed dynamically by the insole and the hollow cylinders to increase the resiliency. The impact is stronger, the open top is sealed more tightly, since the counterforce is greater as the impact become stronger, which is similar to the principle that in wheels without inner tubes which are normally used in car, the outer tube is jointed with the hub better under greater inner pressure. Meanwhile, an air layer which is formed between the insole and the recess is of nice performance in heat insulation.

Preferably, rubber may be filled among the hollow cylinders in the recess, so as to increase the resiliency and support people with greater weight.

Preferably, the hollow cylinder has a diameter of 0.5 to 2 cm.

The sole according to the present invention is of simple structure, low cost, nice resiliency, and is durable and able to moderate impact to be deformed with different extent according to the pressures at different positions so as to enable the foot to endure the minimum pressure. The open tops of the hollow cylinders that are arched surfaces are of the function of massage to the feet.

DETAILED DESCRIPTION OF THE INVENTION

Figure 1:
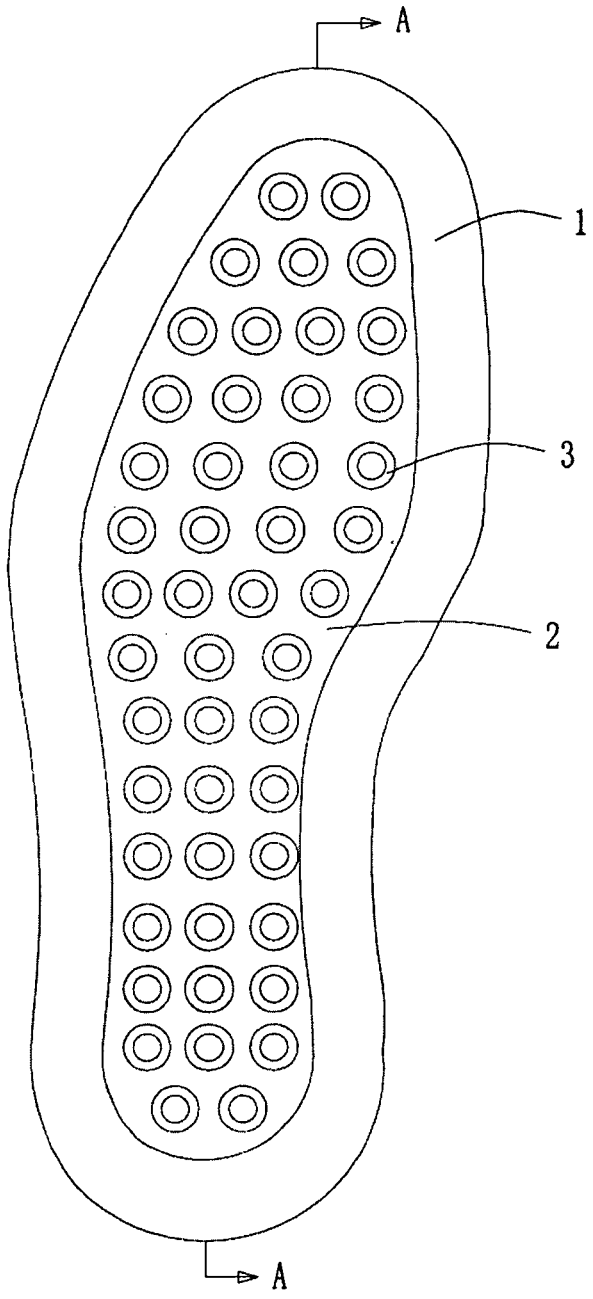
FIG. 1 is a front view of a sole according to an embodiment of the present invention.
Figure 2:
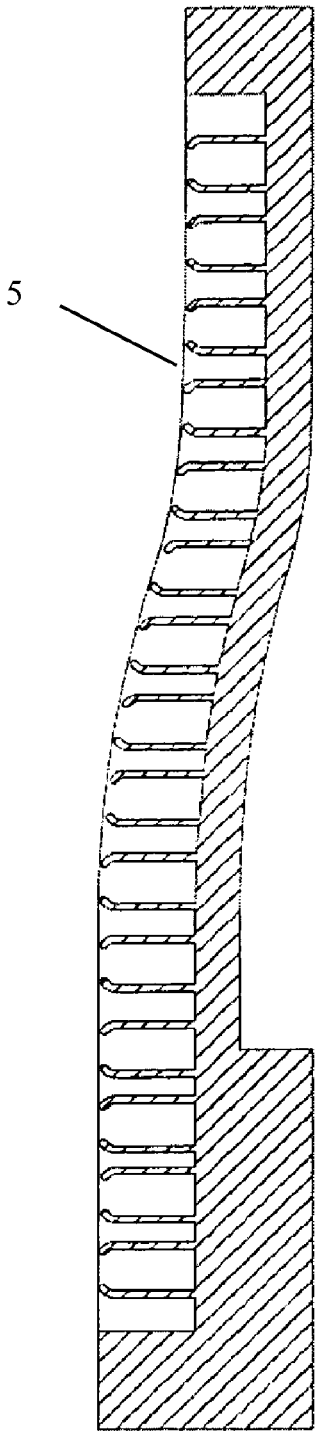
FIG. 2 is a sectional view of the sole of FIG. 1, taking along the A-A line.
Figure 3:
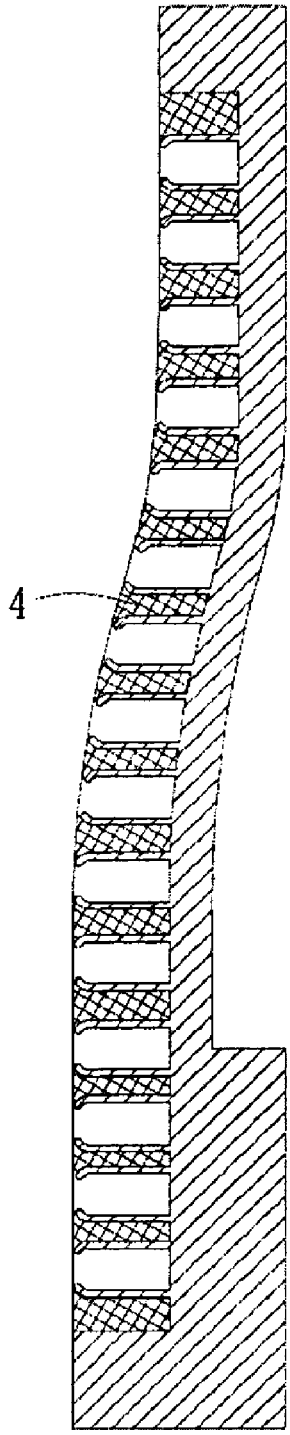
FIG. 3 is a sectional view of a sole according to another embodiment of the present invention, also taking along the A-A line.

A sole according to an embodiment is shown in FIGS. 1, 2, the sole 1 is provided with a foot-shaped recess 2 in which hollow cylinders 3 are arranged entirely or locally in loops or rows or columns, as shown in FIG. 2. Rubber may be filled among the hollow cylinders, for example, a piece of rubber 4 on which holes are provided corresponding to the resilient hollow cylinders maybe used to filed within the recess 2. Each of the hollow cylinders has an open top that is an arched surface and capable to be closed, and has a diameter of 0.5 to 2 cm. The resilient hollow cylinders and the sole are made of rubber materials by one step molding.

The open top of the hollow cylinder is an arched surface and capable to be closed. The arched surface changes the support manner of the hollow cylinder to the foot, the force of body acting on the arched surface of the hollow cylinder is not vertical since a certain degree is formed between the gravity of human body and the impact force to the cylinder. Therefore, the vertical supporting force will form a bending force which is then transferred from the arched surface to the lower portion of the cylinder and thus changes the supporting principle of the hollow cylinder, and the hollow cylinders having the arched surface will be constricted upon a certain pressure.

After the sole is made into the shoe, the resilient hollow cylinders are covered and sealed by the insole 5 as shown in FIG. 2, the arched or spherical surfaces are engaged with the insole 5, and air is thus sealed inside each of the cylinders, the air inside the cylinder will assist the resilient hollow cylinder to return its normal state after the pressure is released.

Since rubber material is of resilient performance and resistance to bending and the air inside the cylinder will assist the resilient hollow cylinder to return its normal state, the hollow cylinder can be deformed freely. The structure of the present invention increases the resilient effect greatly and moderates impact effectively. It also improves the comfort degree since each of the cylinders can be deformed independently to be adapted to the shape of the foot and to minimize the pressure on the foot.

The invention claimed is:

1. A resilient sole, comprising:

an upper layer;

a foot-shaped recess on the upper layer of the sole;

a plurality of resilient hollow cylinders arranged in the recess, each of the hollow cylinders being resilient and having an open top with an arched circumferential surface; and an insole that covers and seals the respective arched circumferential surface of the hollow cylinders to completely close the respective open top of the hollow cylinders under a user's weight or impact, thereby sealing air inside the hollow cylinders, wherein the air sealed inside each of the hollow cylinders is configured to generate a pressure in reaction to the user's weight or impact, and wherein each of the hollow cylinders is deformable independently.

2. The resilient sole of claim 1, wherein the open top of each hollow cylinder is an spherical surface.

3. The resilient sole of claim 1, wherein the hollow cylinders have a diameter of 0.5 to 2 cm.

4. The resilient sole of claim 1, wherein rubber is filled among the hollow cylinders.

* * * * *